US010074462B2

(12) United States Patent
Brueckner et al.

(10) Patent No.: US 10,074,462 B2
(45) Date of Patent: Sep. 11, 2018

(54) CABLE HAVING A PLUGGABLE CONNECTOR

(71) Applicant: MD ELEKTRONIK GmbH, Waldkraiburg (DE)

(72) Inventors: Sebastian Brueckner, St. Wolfgang (DE); Markus Daiminger, Ampfing (DE); Thomas Kirschner, Egglkofen (DE); Stefan Sperr, St. Wolfgang (DE)

(73) Assignee: MD ELEKTRONIK GmbH, Waldkraiburg (DE)

( * ) Notice: Subject to any disclaimer, the term of this patent is extended or adjusted under 35 U.S.C. 154(b) by 0 days.

(21) Appl. No.: 15/494,562

(22) Filed: Apr. 24, 2017

(65) Prior Publication Data

US 2017/0323706 A1 Nov. 9, 2017

(30) Foreign Application Priority Data

May 4, 2016 (EP) ..... 16168318

(51) Int. Cl.
*H01B 7/40* (2006.01)
*H01B 7/24* (2006.01)
(Continued)

(52) U.S. Cl.
CPC ..... *H01B 7/40* (2013.01); *H01B 7/24* (2013.01); *H01R 4/20* (2013.01); *H01R 9/0518* (2013.01);
(Continued)

(58) Field of Classification Search
None
See application file for complete search history.

(56) References Cited

U.S. PATENT DOCUMENTS 3,227,993 A * 1/1966 Bentley ..... H01R 9/0518 439/585
3,277,233 A * 10/1966 Ross ..... F16L 9/125 174/47
(Continued)

FOREIGN PATENT DOCUMENTS

DE 1615624 B1 6/1971
DE 202011101380 U1 8/2011
(Continued)

OTHER PUBLICATIONS

Tampere University of Technology—Sanna Nykanen, Polyarylsulfone (PSU) and Polyarylethersulfone (PES), CAE DS—Plastics for Injection Moulding, Polyarylsulfone and polyarlylethersulfone 1-3.*
(Continued)

*Primary Examiner* — Chau N Nguyen
*Assistant Examiner* — Muhammed Azam
(74) *Attorney, Agent, or Firm* — Leydig, Voit & Mayer, Ltd.

(57) ABSTRACT

A cable having a pluggable connector includes an inner conductor, an insulation disposed radially outwardly with respect to the inner conductor, a shield disposed radially outwardly with respect to the insulation and a jacket. A support ferrule has a plurality of tongues extending in a direction having an axial component. A sleeve has a first section, a second section and a third section. The first and second sections are disposed radially outwardly with respect to the support ferrule. The second section has a radial constriction. The sleeve encloses the tongues of the support ferrule in the second section and encloses the jacket in the third section. The second section is disposed in the axial direction between the first section and the third section.

19 Claims, 2 Drawing Sheets

(51) Int. Cl.
*H01R 9/05* (2006.01)
*H01R 4/20* (2006.01)
*H01R 13/6592* (2011.01)

(52) U.S. Cl.
CPC ..... *H01R 13/6592* (2013.01); *H01R 2201/26* (2013.01)

(56) References Cited

U.S. PATENT DOCUMENTS 3,331,917 A * 7/1967 O'Keefe ..... H01R 9/0518 439/877
3,370,122 A * 2/1968 Ichikawa ..... H01R 4/10 174/71 R
3,406,373 A 10/1968 Forney, Jr.
3,683,320 A * 8/1972 Woods ..... H01R 9/0521 439/198
3,701,086 A * 10/1972 Somerset ..... H01R 24/562 174/75 C
3,710,005 A * 1/1973 French ..... H01R 9/05 174/75 C
3,744,011 A * 7/1973 Blanchenot ..... H01R 9/0521 439/584
3,879,102 A * 4/1975 Horak ..... H01R 9/0521 439/89
3,982,060 A * 9/1976 Avery ..... H01R 24/40 174/75 C
4,053,200 A * 10/1977 Pugner ..... H01R 9/0518 174/89
4,345,370 A * 8/1982 Cartier ..... H01R 24/562 140/105
4,447,100 A * 5/1984 Dyce ..... H01R 13/6592 174/75 C
4,692,561 A * 9/1987 Nattel ..... H02G 15/013 174/653
4,898,545 A * 2/1990 Endo ..... H01R 9/0518 439/578
5,066,248 A * 11/1991 Gaver, Jr. ..... H01R 9/053 439/394
5,217,392 A * 6/1993 Hosler, Sr. ..... H01R 9/0503 174/88 C
5,498,176 A * 3/1996 Hashizawa ..... H01R 24/38 439/585
5,631,444 A * 5/1997 Rook ..... H01R 4/646 174/78
5,637,830 A * 6/1997 Hashizawa ..... H01R 9/0521 174/84 R
5,685,072 A * 11/1997 Wright ..... H01R 9/053 29/866
5,965,847 A * 10/1999 Tanaka ..... H01R 9/0527 174/84 R
5,975,948 A * 11/1999 Weaver ..... H01R 43/20 439/578
6,152,746 A * 11/2000 Brown ..... H01R 9/0518 439/99
6,201,189 B1 * 3/2001 Carlson ..... G02B 6/4416 174/102 R
6,648,683 B2 * 11/2003 Youtsey ..... H01R 9/0527 439/578
6,817,896 B2 * 11/2004 Derenthal ..... H01R 9/05 439/578
6,910,910 B2 * 6/2005 Cairns ..... G02B 6/3816 174/13
7,048,579 B2 * 5/2006 Montena ..... H01R 9/0524 439/578
7,086,897 B2 * 8/2006 Montena ..... H01R 9/0524 439/460
7,097,499 B1 * 8/2006 Purdy ..... H01R 9/0521 439/578
7,726,985 B2 * 6/2010 Gladd ..... H01R 9/0518 439/585
7,828,595 B2 * 11/2010 Mathews ..... H01R 9/0524 439/578
7,868,251 B2 * 1/2011 Gladd ..... H01R 13/5205 174/72 A
7,934,954 B1 * 5/2011 Chawgo ..... H01R 9/0524 439/578
8,062,063 B2 * 11/2011 Malloy ..... H01R 13/187 439/578
8,157,589 B2 * 4/2012 Krenceski ..... H01R 9/0524 439/578
8,167,646 B1 * 5/2012 Mathews ..... H01R 9/05 439/578
8,366,481 B2 * 2/2013 Ehret ..... H01R 9/05 439/578
8,450,610 B2 * 5/2013 Alvelo ..... H01B 7/18 174/84 R
8,834,200 B2 * 9/2014 Shaw ..... H01R 13/46 439/578
9,071,019 B2 * 6/2015 Burris ..... H01R 13/639
9,153,911 B2 * 10/2015 Burris ..... H01R 13/6581
9,530,543 B2 * 12/2016 Friesinger ..... H01B 11/1895
9,667,000 B1 * 5/2017 Morello ..... H01R 24/38
9,673,578 B1 * 6/2017 Lane ..... H01R 24/40
2002/0134573 A1 * 9/2002 Christman ..... H01R 13/5845 174/84 R
2003/0190840 A1 * 10/2003 Fegley ..... H01R 9/0518 439/578
2006/0110977 A1 * 5/2006 Matthews ..... H01R 9/0524 439/578
2008/0214049 A1 * 9/2008 Gump ..... H01R 9/0518 439/607.01
2010/0288528 A1 * 11/2010 Houston ..... H01B 11/1895 174/102 R
2011/0011484 A1 * 1/2011 Evoniuk ..... H02G 15/1833 138/177
2011/0230091 A1 * 9/2011 Krenceski ..... H01R 9/0524 439/578
2015/0024626 A1 * 1/2015 Lu ..... H01R 9/0518 439/578

FOREIGN PATENT DOCUMENTS

DE 102012025344 A1 6/2014
DE 202015000751 U1 3/2015
EP 0738027 A1 10/1996
EP 0841718 A2 5/1998
EP 0993075 A2 4/2000
EP 1965465 A2 9/2008

OTHER PUBLICATIONS

Matweb, Overview of materials for Brass, http://www.matweb.com/search/datasheet_print.aspx?matguid=d3bd4617903543ada92f4c101c2a20e5.*

* cited by examiner

CABLE HAVING A PLUGGABLE CONNECTOR

CROSS-REFERENCE TO PRIOR APPLICATION

Priority is claimed to European Patent Application No. EP 16168318.0, filed on May 4, 2016, the entire disclosure of which is hereby incorporated by reference herein.

FIELD

The present invention relates to a cable assembly including a pluggable or plug-type connector and suitable, in particular, for transmitting electrical signals.

Such cables can be used in motor vehicles or aircraft, for example, and are mostly required in large quantities. Simple construction and simple preassembly are important factors in the economic supply of corresponding cables. Such cables must be manufactured such that they are capable of transmitting signals at high data rates, as required for high-quality video signal transmission, for example. Moreover, such cables must be rugged in construction. In particular, the pluggable connector must be attached to the conductor in such a way that a defined minimum pull-off strength is ensured.

BACKGROUND

German publication DE 20 2015 000 751 U1 describes a cable intended to ensure a strong and high-tensile connection between a plug-type connector and a lead. This connection is intended to be optimally electrically matched, preferably over its entire extent in the longitudinal direction of the cable. The corresponding cable has a sleeve having a constriction in the region of the cores of the cable.

SUMMARY

In an embodiment, the present invention provides a cable having a pluggable connector. The cable includes an inner conductor, an insulation disposed radially outwardly with respect to the inner conductor, a shield disposed radially outwardly with respect to the insulation and a jacket. A support ferrule has a plurality of tongues extending in a direction having an axial component. A sleeve has a first section, a second section and a third section. The first and second sections are disposed radially outwardly with respect to the support ferrule. The second section has a radial constriction. The sleeve encloses the tongues of the support ferrule in the second section and encloses the jacket in the third section. The second section is disposed in the axial direction between the first section and the third section.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
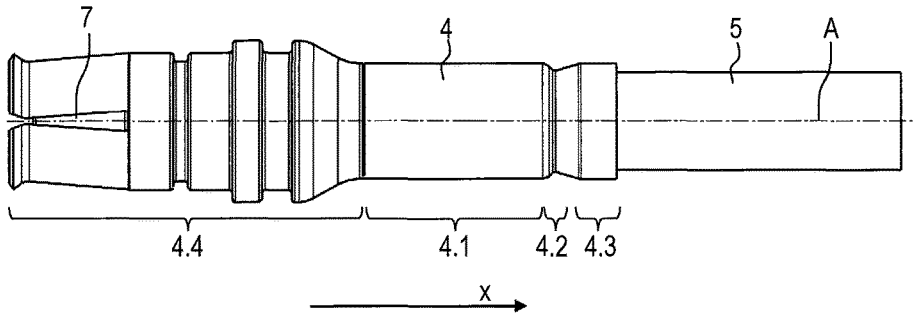
FIG. 1 is a side view of the cable.

In an embodiment, the present invention provides a cable which is rugged, yet relatively simple to manufacture.

In accordance with an embodiment of the present invention, the cable has a pluggable connector including an inner conductor, an insulation, a shield, a sleeve, a jacket, and a support ferrule. The insulation is disposed radially outwardly with respect to the inner conductor and thus encloses the same. Furthermore, the shield is disposed radially outwardly with respect to the insulation. The support ferrule has a plurality of tongues extending in a direction having an axial component. The sleeve has a first section, a second section and a third section, the first and second sections being disposed radially outwardly with respect to the support ferrule. The second section has a radial constriction, so that the sleeve has a narrowed inner cross section in this section. In particular, the sleeve is configured to have its minimum inner cross section in the second section. The sleeve encloses the tongues of the support ferrule in the second section. Furthermore, the sleeve encloses the jacket in the third section. The cable is configured such that the second section is disposed axially (in the axial direction) between the first section and the third section.

In the following, the term "enclose" will be understood to refer to an arrangement in which one component of the cable surrounds another component, and thus is disposed radially outwardly with respect thereto, i.e., is disposed radially outwardly thereof. In this arrangement, the one component may either touch or contact the other component or a plurality of intermediate elements may be provided between the respective components.

The support ferrule has a plurality of tongues extending in a direction having an axial component. These are, in particular, elements which are disposed or integrally formed on the support ferrule such that they project therefrom with an axial directional component. "Axial direction" is understood to mean a direction along the longitudinal axis of the pluggable connector. In particular, this is the direction in which the pluggable connector is to be operated during normal operation. Consequently, the pluggable connector can be caused to make or break electrical contact with a mating part by pushing or pulling, respectively, in a direction parallel to the axis.

The present invention relates to cables having either one inner conductor or a plurality of cores which are electrically insulated from each other.

Advantageously, the support ferrule is made from rolled sheet metal, in particular, as an open crimp barrel.

In an advantageous construction, the cable is configured such that the sleeve is made of a first material and the support ferrule is made of a second material different from the first material. In particular, both materials are metallic materials.

In a further embodiment of the present invention, the first material has a lower modulus of elasticity than the second material.

In an advantageous embodiment of the present invention, the support ferrule has at least three tongues extending in a direction having an axial component.

The present invention can be used particularly advantageously for miniaturized cables whose support ferrules have a maximum diameter of less than 50 mm, in particular less than 10 mm, and especially less than 8 mm.

Advantageously, the cable is manufactured such that the radial constriction is circumferential in configuration.

In another embodiment of the present invention, the radial constriction has a substantially V-shaped longitudinal cross-sectional geometry. This observation refers in particular to a plane of section extending longitudinally through the sleeve.

Advantageously, the tongues of the support ferrule are disposed at equal angular offsets along the circumference of the support ferrule. The angular offset between two adjacent tongues is then in particular 360/n, with n being the number of tongues and the respective angular offset being determined between the centers of the respective tongues. Accordingly, the tongues of the support ferrule are advantageously circumferentially spaced at equal distances from each other.

In an advantageous embodiment of the present invention, the sleeve, in particular the second section thereof, is configured such that its inner side has a first conical surface which bears against the tongues.

Advantageously, the sleeve is configured such that its inner side has a second conical surface which bears against the jacket.

In a further embodiment of the present invention, the shield is folded back and the support ferrule is disposed radially between two layers of the shield. The sleeve encloses the two layers of the shield in the first section; i.e., the first section is disposed radially outwardly with respect to the two layers of the shield. The shield may in particular be composed of multiple layers, such as, for example, a foil and a wire mesh. In this case, only one layer, for example the wire mesh, may be folded back.

FIG. 1 shows a cable for transmitting signals and intended, in particular, for installation in a vehicle. The signals may transmit, for example, video images from a camera to an on-board computer. The end of the cable can be detachably connected by the pluggable connector to a mating part of another component, such as, for example, an element of an on-board electronic system, in the manner of a plug-type connection. In the exemplary embodiment presented here, a single-piece sleeve 4 mechanically and electrically connected to a lead (as shown in FIG. 1) serves as an outer conductor of the pluggable connector. Sleeve 4 has a longitudinal axis A extending along an axial direction x. The present invention is especially advantageous for cables having a very small outside diameter. In the exemplary embodiment presented here, the lead has an outside diameter of 3.3 mm.

Figure 2:
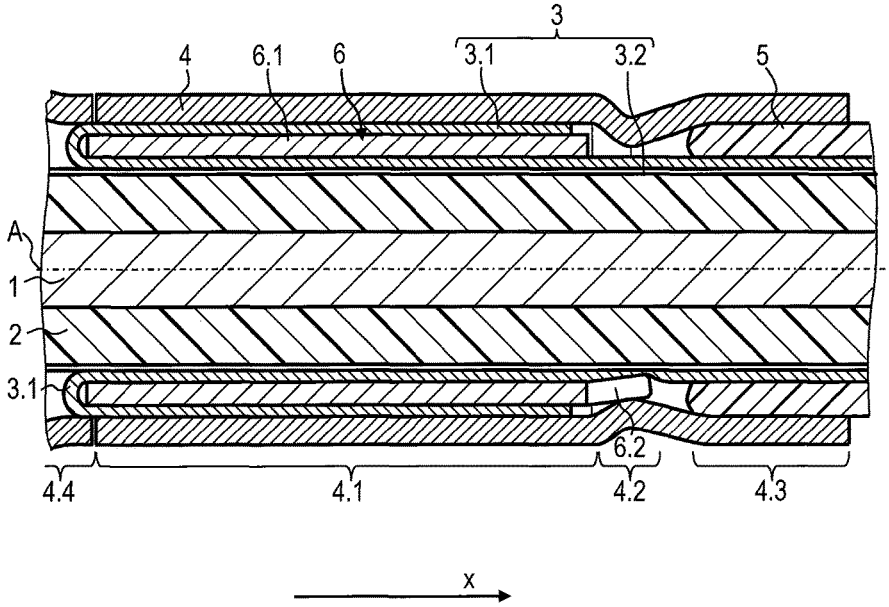
FIG. 2 is a longitudinal sectional detail view of the cable.

FIG. 2 shows a longitudinal sectional detail view of the cable of FIG. 1. Accordingly, in the exemplary embodiment presented here, the cable has an inner conductor 1 composed, for example, of a plurality of strands. A hollow cylindrical insulating layer 2 is disposed radially outwardly of inner conductor 1.

Furthermore, the cable includes, in particular, a lead and a shield 3, which here includes a wire mesh 3.1 and a foil 3.2 and surrounds insulating layer 2. Disposed radially outwardly of shield 3 is an insulating jacket 5, which encloses shield 3 over most of the length of the cable.

During manufacture of the cable, first such a lead is provided. The lead is cut to length and jacket 5 is removed from the end of the lead. This step is performed such that afterwards shield 3 is exposed at the respective end of the lead.

Figure 3:
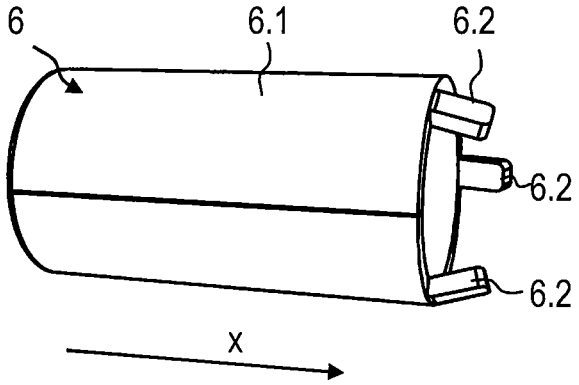
FIG. 3 is a perspective view of the support ferrule.

Then, a support ferrule 6 is placed around shield 3. Support ferrule 6 may be configured as an open or closed sleeve 1.4, in particular as an open or closed crimp barrel as defined in DIN EN 60352-2. FIG. 3 shows support ferrule 6 subsequent to processing. In the exemplary embodiment presented in FIG. 3, support ferrule 6 is made from rolled sheet metal and thus has an open configuration. The material used for support ferrule 6 may be, for example, a stainless steel having a modulus of elasticity of 200 GPa. Support ferrule 6 is made of an electrically conductive material. After compression, support ferrule 6 has a substantially hollow cylindrical section 6.1 as well as three tongues 6.2. In the exemplary embodiment presented here, tongues 6.2 are integrally formed on hollow cylindrical section 6.1.

After support ferrule 6 has been placed around shield 3, support ferrule 6 is compressed or crimped so that it is fixedly secured on shield 3 radially outwardly of the exposed shield 3, in particular on wire mesh 3.1. Here, the outside diameter of support ferrule 6 is only 3 mm.

Then, the exposed shield 3; i.e., the end of shield 3, in particular of wire mesh 3.1, projecting from support ferrule 6 toward the end of the lead, is folded back. In the exemplary embodiment presented here, foil 3.2 is not folded back.

Accordingly, support ferrule 6 is then disposed between a first layer and a second layer of wire mesh 3.1 within an axial section extending along longitudinal axis A. The first layer of wire mesh 3.1 is located radially further inwardly relative to the second layer of wire mesh 3.1.

Next, insulating layer 2 is removed from the end of the lead. A contact is attached to the lead prepared in this manner. In particular, a contact is fixed on the stripped end of inner conductor 1, here by a crimping process. Then, the contact is inserted into a dielectric (i.e., electrically insulating) contact holder 7 (FIG. 1).

Subsequently, sleeve 4 is placed around the second layer of wire mesh 3.1. Sleeve 4 may also be configured as an open or closed crimp barrel, in particular as defined in DIN EN 60352-2. In the exemplary embodiment presented here, sleeve 4 is also open and made of electrically conductive material, here phosphorous bronze having a modulus of elasticity of 115 GPa.

Then, sleeve 4 is compressed or crimped so that sleeve 4 is fixedly secured on shield 3. Since the material of sleeve 4 has a lower modulus of elasticity than the material of support ferrule 6, the pull-off strength can be increased. In addition, it is possible to achieve a higher torsional resistance of the cable in the joining region.

The cable is configured such that sleeve 4 has a first section 4.1, a second section 4.2, a third second 4.3 and a fourth section 4.4, the sections being arranged in succession in axial direction x. Second section 4.2 is disposed in axial direction x between first section 4.1 and third section 4.3.

First section 4.1 and second section 4.2 enclose support ferrule 6; i.e., are disposed radially further outwardly with respect to support ferrule 6.

Furthermore, second section 4.2 has a radial constriction extending around the circumference thereof, the constriction being formed by the compression or crimping process. As can be seen, for example, in FIG. 2 (in the upper and lower cross-sectional areas along the length of sleeve 4), the radial constriction has a substantially V-shaped longitudinal cross-sectional geometry. This second section 4.2 of sleeve 4 encloses tongues 6.2, which extend in a direction having a component in axial direction x. Second section 4.2 is configured such that its inner side has a conical surface which bears against tongues 6.2. As a result of the crimping process and the formation of the circumferential constriction, tongues 6.2 are bent radially inwardly and extend obliquely radially inwardly, so that tongues 6.2 are pressed into wire mesh 3.1. Therefore, tongues 6.2 rest under mechanical bias against shield 3, in particular against wire mesh 3.1.

Third section 4.3 is the portion of sleeve 4 that encloses jacket 5. Due to the constriction, sleeve 4 bears positively against jacket 5 in axial direction x.

The V-shaped longitudinal cross-sectional geometry and the two associated opposite conical surfaces on the inner side of sleeve 4 allow for a relatively large tolerance range for the axial position of sleeve 4 relative to jacket 5, on the one hand, and relative to support ferrule 6, on the other hand.

Alternatively to the exemplary embodiment presented here, the cable may also be configured such that shield 3, respectively wire mesh 3.1, is not folded back and, in particular, that sleeve 4 then not only encloses support ferrule 6 in first section 4.1, but is in direct contact therewith.

The present invention makes it possible to produce a cable which, despite having a relatively small diameter, has, inter alia, high pull-off strength values; i.e., a cable where large forces are required to release the connection between the lead and sleeve 4.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A cable having a pluggable connector, the cable comprising:

an inner conductor;

an insulation disposed radially outwardly with respect to the inner conductor;

a shield disposed radially outwardly with respect to the insulation;

a jacket;

a support ferrule having a plurality of tongues, the tongues extending in a direction having an axial component; and a sleeve having a first section, a second section and a third section, the first and second sections being disposed radially outwardly with respect to the support ferrule, the second section having a radial constriction, the sleeve enclosing the tongues of the support ferrule in the second section and enclosing the jacket in the third section, and the second section being disposed in an axial direction between the first section and the third section, wherein the shield is folded back and the support ferrule is disposed radially between two layers of the shield, and wherein the sleeve encloses the two layers of the shield in the first section, and wherein the cable extends from a first end to a second end, the sleeve being disposed at least at the first end of the cable and the shield extending along the cable from below the sleeve at the first end to the second end.

2. The cable as recited in claim 1, wherein the support ferrule is made from rolled sheet metal.

3. The cable as recited in claim 1, wherein the sleeve is made of a first material and the support ferrule is made of a second material different from the first material.

4. The cable as recited in claim 3, wherein the first material has a lower modulus of elasticity than the second material.

5. The cable as recited in claim 1, wherein the tongues of the support ferrule are disposed at equal angular offsets along a circumference of the support ferrule.

6. The cable as recited in claim 1, wherein the support ferrule has at least three tongues each extending in the direction having the axial component.

7. The cable as recited in claim 1, wherein the support ferrule has a diameter of less than 50 mm.

8. The cable as recited in claim 1, wherein the radial constriction is circumferential in configuration.

9. The cable as recited in claim 1, wherein the radial constriction has a substantially V-shaped longitudinal cross-sectional geometry.

10. The cable as recited in claim 1, wherein the sleeve is configured such that an inner side of the sleeve has a conical surface which bears against the tongues.

11. The cable as recited in claim 1, wherein the sleeve is configured such that an inner side of the sleeve has a conical surface which bears against the jacket.

12. A cable having a pluggable connector, the cable comprising:

an inner conductor;

an insulation disposed radially outwardly with respect to the inner conductor;

a shield disposed radially outwardly with respect to the insulation;

a jacket;

a support ferrule having a plurality of tongues, the tongues extending in a direction having an axial component; and a sleeve having a first section, a second section and a third section, the first and second sections being disposed radially outwardly with respect to the support ferrule, the second section having a radial constriction, the sleeve enclosing the tongues of the support ferrule in the second section and enclosing the jacket in the third section, and the second section being disposed in an axial direction between the first section and the third section, wherein the shield is folded back and the support ferrule is disposed radially between two layers of the shield, and wherein the sleeve encloses the two layers of the shield in the first section, and wherein the radial constriction has a substantially V-shaped longitudinal cross-sectional geometry.

13. The cable as recited in claim 1, wherein the shield comprises a wire mesh.

14. The cable as recited in claim 1, wherein the shield comprises a foil layer and a wire mesh layer, and wherein only the wire mesh layer is folded back.

15. The cable as recited in claim 1, wherein the shield extends along substantially an entire length of the cable and is folded back at an end.

16. A cable having a pluggable connector, the cable comprising:

an inner conductor;

an insulation disposed radially outwardly with respect to the inner conductor;

a shield disposed radially outwardly with respect to the insulation;

a jacket;

a support ferrule having a plurality of tongues, the tongues extending in a direction having an axial component; and a sleeve having a first section, a second section and a third section, the first and second sections being disposed radially outwardly with respect to the support ferrule, the second section having a radial constriction, the sleeve enclosing the tongues of the support ferrule in the second section and enclosing the jacket in the third section, and the second section being disposed in an axial direction between the first section and the third section, wherein the shield is folded back and the support ferrule is disposed radially between two layers of the shield, and wherein the sleeve encloses the two layers of the shield in the first section, and wherein the shield comprises a foil layer and a wire mesh layer, and wherein only the wire mesh layer is folded back.

17. A cable having a pluggable connector, the cable comprising:

an inner conductor;

an insulation disposed radially outwardly with respect to the inner conductor;

a shield disposed radially outwardly with respect to the insulation;

a jacket;

a support ferrule having a plurality of tongues, the tongues extending in a direction having an axial component; and a sleeve having a first section, a second section and a third section, the first and second sections being disposed radially outwardly with respect to the support ferrule, the second section having a radial constriction, the sleeve enclosing the tongues of the support ferrule in the second section and enclosing the jacket in the third section, and the second section being disposed in an axial direction between the first section and the third section, wherein the shield is folded back and the support ferrule is disposed radially between two layers of the shield, and wherein the sleeve encloses the two layers of the shield in the first section, and wherein the support ferrule is made from rolled sheet metal.

18. A cable having a pluggable connector, the cable comprising:

an inner conductor;

an insulation disposed radially outwardly with respect to the inner conductor;

a shield disposed radially outwardly with respect to the insulation;

a jacket;

a support ferrule having a plurality of tongues, the tongues extending in a direction having an axial component; and a sleeve having a first section, a second section and a third section, the first and second sections being disposed radially outwardly with respect to the support ferrule, the second section having a radial constriction, the sleeve enclosing the tongues of the support ferrule in the second section and enclosing the jacket in the third section, and the second section being disposed in an axial direction between the first section and the third section, wherein the shield is folded back and the support ferrule is disposed radially between two layers of the shield, and wherein the sleeve encloses the two layers of the shield in the first section, wherein the sleeve is made of a first material and the support ferrule is made of a second material different from the first material, and wherein the first material has a lower modulus of elasticity than the second material.

19. A cable having a pluggable connector, the cable comprising:

an inner conductor;

an insulation disposed radially outwardly with respect to the inner conductor;

a shield disposed radially outwardly with respect to the insulation;

a jacket;

a support ferrule having a plurality of tongues, the tongues extending in a direction having an axial component; and a sleeve having a first section, a second section and a third section, the first and second sections being disposed radially outwardly with respect to the support ferrule, the second section having a radial constriction, the sleeve enclosing the tongues of the support ferrule in the second section and enclosing the jacket in the third section, and the second section being disposed in an axial direction between the first section and the third section, wherein the shield is folded back and the support ferrule is disposed radially between two layers of the shield, and wherein the sleeve encloses the two layers of the shield in the first section, and wherein the support ferrule has a diameter of less than 50 mm.

* * * * *